US009995139B2

(12) United States Patent
Chu et al.

(10) Patent No.: US 9,995,139 B2
(45) Date of Patent: Jun. 12, 2018

(54) SURROUNDING ROCK PRETREATMENT METHOD FOR TBM PASSING THROUGH ROUND TUNNEL SECTION WITH HIGH ROCK-BURST RISK

(71) Applicant: PowerChina Huadong Engineering Corporation Limited, Hangzhou (CN)

(72) Inventors: Weijiang Chu, Hangzhou (CN); Chunsheng Zhang, Hangzhou (CN); Jing Hou, Hangzhou (CN); Yong Zhou, Hangzhou (CN); Pingzhi Chen, Hangzhou (CN)

( * ) Notice: Subject to any disclaimer, the term of this patent is extended or adjusted under 35 U.S.C. 154(b) by 0 days. days.

(21) Appl. No.: 15/632,291

(22) Filed: Jun. 23, 2017

(65) Prior Publication Data

US 2018/0010452 A1 Jan. 11, 2018

(30) Foreign Application Priority Data

Jul. 6, 2016 (CN) ..... 2016 1 0541258

(51) Int. Cl.
*E21D 9/00* (2006.01)
*E21D 9/10* (2006.01)

(52) U.S. Cl.
CPC ..... *E21D 9/006* (2013.01); *E21D 9/10* (2013.01)

(58) Field of Classification Search
CPC .. E21D 9/00; E21D 9/006; E21D 9/10; F42D 3/04; F42D 1/00; E21F 17/00
(Continued)

(56) References Cited

U.S. PATENT DOCUMENTS 3,877,373 A * 4/1975 Bergmann ..... E21C 37/00 102/201
4,090,447 A * 5/1978 Johnsen ..... F42B 3/08 102/313

(Continued)

FOREIGN PATENT DOCUMENTS

CN 101915104 A * 12/2010
CN 101967977 * 2/2011

(Continued)

OTHER PUBLICATIONS

Barton, N., Reducing risk in long deep tunnels by using TBM and drill-and-blast methods in the same project—they hybrid solution, 2012, Journal of Rock Mechanics and Geotechnical Engineering, pp. 115-126 (Year: 2012).*

(Continued)

*Primary Examiner* — Carib A Oquendo
(74) *Attorney, Agent, or Firm* — Wayne & Ken, LLC; Tony Hom

(57) ABSTRACT

The present invention relates to a surrounding rock pretreatment method for a TBM (tunnel boring machine) passing through a round tunnel section with high rock-burst risk. A technical solution of the present invention is as follows: the surrounding rock pretreatment method includes the following steps: 1. determining a pretreatment area, wherein an area in which a clear spacing between a to-be-constructed tunnel and an adjacent existing tunnel in a TBM tunneling direction is less than 2 times that of a tunnel diameter of the TBM to-be-constructed tunnel is the pretreatment area: 2. performing controlled blasting; 3. injecting high pressure water, and selecting part of blast holes I to perform cyclic water injection pressurizing; and 4, performing normal tunneling by the TBM.

6 Claims, 2 Drawing Sheets

(58) Field of Classification Search
USPC ..... 299/11, 12, 13; 102/311, 313
See application file for complete search history.

(56) References Cited

U.S. PATENT DOCUMENTS

| | | | | |
|---|---|---|---|---|
| 2002/0070600 | A1* | 6/2002 | Ro | E21C 37/16 299/13 |
| 2013/0200680 | A1* | 8/2013 | Cho | E21D 9/1066 299/1.4 |
| 2013/0263752 | A1* | 10/2013 | Lee | F42D 3/00 102/303 |

FOREIGN PATENT DOCUMENTS

| | | | |
|---|---|---|---|
| CN | 104533430 | * | 4/2015 |
| CN | 204457781 | * | 7/2015 |
| JP | 201031556 | * | 2/2012 |

OTHER PUBLICATIONS

Mazaira, A., Konicek, P., Intense rockburst impacts in deep underground construction and their prevention, 2015, Canadian Geotechnical Journal, pp. 1426-1439 (Year: 2015).*

Wang, J., Zeng, X., Zhou, J., Practices on rockburst prevention and control in headrace tunnels of Jingping II hydropower station, 2012, Journal of Rock Mechanics and Geotechnical Engineering, pp. 258-268 (Year: 2012).*

* cited by examiner

SURROUNDING ROCK PRETREATMENT METHOD FOR TBM PASSING THROUGH ROUND TUNNEL SECTION WITH HIGH ROCK-BURST RISK

TECHNICAL FIELD

The present invention relates to a surrounding rock pretreatment method for a IBM passing through a round tunnel section with high rock-burst risk.

BACKGROUND

For deep-buried tunnels, if a tunnel spacing is too small, a high stress area may be produced in rock pillars between two tunnels due to stress concentration, and the area tends to have energy accumulation, so relatively high rock-burst risk is generated. When the IBM passes through an adjacent tunnel, if a dear spacing between the two tunnels is too small, the rock-burst risk is obviously increased.

SUMMARY

A technical problem to be solved in the present invention is as follows: with respect to the above problems, a surrounding rock pretreatment method for a IBM passing through a round tunnel section with high rock-burst risk is provided, so that a high stress area cannot be formed in surrounding rock between two tunnels when the IBM passes through the area, thereby eliminating the rock-burst risk.

A technical solution of the present invention is as follows: the surrounding rock pretreatment method for the IBM passing through the round, tunnel section with high rock-burst risk includes the following steps:

1. determining a pretreatment area, wherein an area in which a clear spacing between a to-be-constructed tunnel and an adjacent existing tunnel in a TBM tunneling direction is less than 2 times that of a tunnel diameter of the TBM to-be-constructed tunnel is the pretreatment area;

2. performing controlled blasting;

2.1. arranging a plurality of rows of blast holes I in the pretreatment area and a rock pillar area between the existing tunnel and the to-be-constructed tunnel through the existing tunnel;

2.2. arranging a plurality of rows of blast holes II on an arch crown of the to-be-constructed tunnel and a spandrel part, far away from the existing tunnel side, of the to-be-constructed tunnel through the existing tunnel;

2.3. sequentially detonating fee blast holes I and the blast holes II.

3. injecting high pressure water, and selecting one part of blast holes I to perform cyclic water injection pressurizing; and 4. performing normal tunneling by the TBM.

A blasting charge length L1 of the blast holes I is equal to ⅓ L, L represents a thickness of rock pillars between the existing tunnel and the to-be-constructed tunnel; and a blasting charge length L2 of the blast holes II is equal to is equal to 1.5 D, and D represents a tunnel diameter of the to-be-constructed tunnel.

A spacing between every two blast holes I along an axis direction of the existing tunnel is 2 m, and a spacing between every two blast holes II along the axis direction of the existing tunnel is 2 m.

A blasting interval of the blast holes I and the blast holes II is 0.5 s.

3 pressure cycles are accumulatively performed during cyclic water injection pressurizing, time of each pressure cycle is more than or equal to 5 minutes, and the maximum pressure is more than or equal to 8 MPa.

Water injection is stopped if water flows out of the blast holes I in which water is not injected in water injection engineering.

The present invention has the beneficial effects that: with respect to a potential high-stress surrounding rock area of a TBM passing through the tunnel section, by virtue of two technological means, that is, controlled blasting relaxation and fracturing of injected high pressure water, artificial cracks are pre-manufactured, and aims of relaxing rock and reducing stress concentration are achieved, thereby eliminating high rock-burst risk of the TBM passing through the tunnel section and creating a safe construction environment.

DETAILED DESCRIPTION

Figure 1:
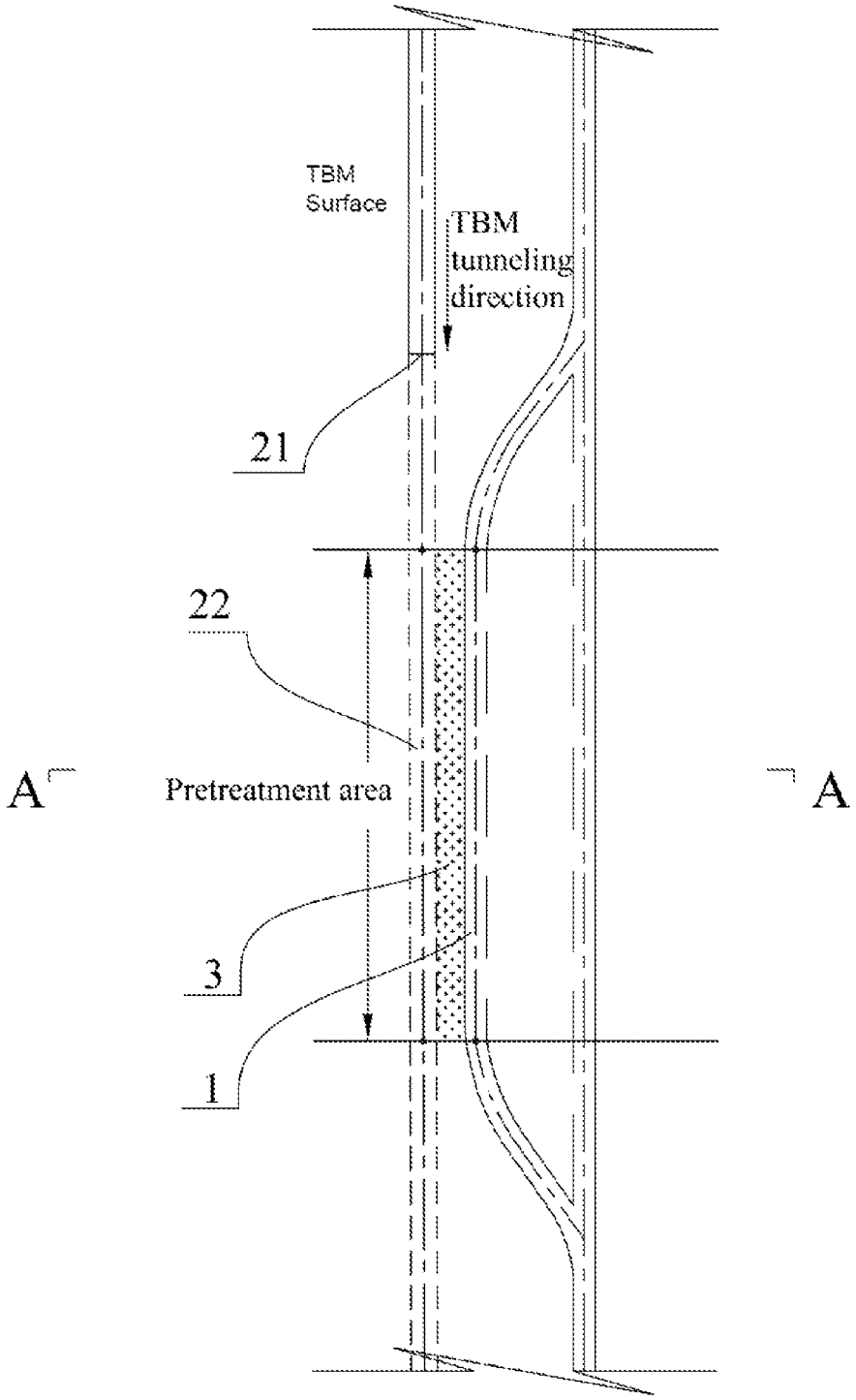
FIG. 1 is a plane layout schematic diagram of embodiments.
Figure 2:
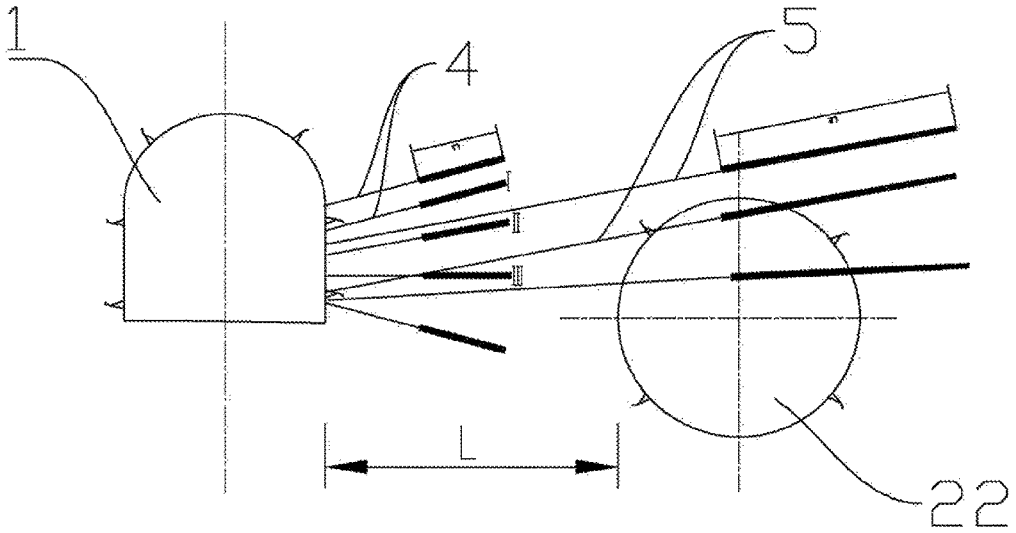
FIG. 2 is an A-A sectional view of FIG. 1.

The present embodiment closes a surrounding rock pretreatment method for a TBM passing through a round tunnel section with high rock-burst risk. As shown in FIG. 1 and FIG. 2, a clear spacing between a round tunnel 1 and a to-be-connected tunnel 22 on a TBM tunneling design route small, and when high rock-burst risk exists in a process of excavating the existing tunnel 1 (round tunnel), surrounding rock of the tunnel section can be pretreated by adopting the method in the present embodiment. The method specifically includes the following steps:

1. determining a pretreatment area, wherein an area in which a clear spacing between the to-be-constructed tunnel 22 and an adjacent existing tunnel 1 in a TBM tunneling direction is less than 2 times that of a tunnel diameter (D) of the TBM to-be-constructed tunnel 22 is the pretreatment area, and the pretreatment area is divided into construction sections 10 m long respectively so as to perform section construction;

2. stopping TBM tunneling when a TBM surface 21 is 50 m away from the pretreatment area, and allowing TBM to continuously perform tunneling after artificial cracks of the surrounding rock in the pretreatment area are completed;

3. performing controlled blasting;

3.1. arranging 5 rows of blast holes I4 in the pretreatment area and a rock pillar 3 (thickness L) area between the round tunnel and the to-be-constructed tunnel 22 through the round tunnel (existing tunnel 1), wherein a spacing between every two blast holes I 4 along an axis direction of the round tunnel is 2 m, the artificial cracks are manufactured in a range of ⅓ time of thickness of the rock pillar 3, and a blasting charge length L1 is equal to ⅓ L;

3.2. arranging 3 rows of blast holes II5 on an arch crown and a right-side spandrel part of the to-be-constructed tunnel 22 through the round tunnel (shown in FIG. 2), wherein a spacing between every two blast holes II5 along the axis direction of the round tunnel is 2 m, a blasting charge length L2 is equal to 1.5 D, and the artificial cracks are manufactured on the TBM arch crown and the right-side spandrel part;

3.3. sequentially detonating the 5 rows of blast holes I4 in the rock pillar area and the 3 rows of blast holes II5 on the TBM arch crown and the right-side spandrel part along the axis direction in the blasting process, wherein a blasting interval is 0.5 s, and cracks are made in the rock pillar area and at the upper right part of the TBM in a 10 m length range;

4. performing cyclic water injection pressurizing on part of the blast holes (holes I, II and III in FIG. 2 are selected on each section) by adopting high pressure water after the controlled blasting in the pretreatment area is completed, wherein totally 3 pressure cycles are performed, time of each cycle is not less than 5 minutes, a pressure-flow curve in the pressurization process is monitored, the orifice section is sealed by 2 m, and the maximum pressure in the water pressurizing cycle should not be lower than 8 MPa. Bursting pressure for allowing the artificial cracks to continuously expand may occur in the first pressure cycle as much as possible, and water injection is stopped if water flows out of other blast holes in the water injection process, to complete water pressurizing cycles of the holes; and 5. allowing the TBM to perform normal tunneling after pretreatment is completed, thereby reducing a tunneling speed when the TBM passes through the pretreatment tunnel section, and ensuring that system anchor bolt support is completed on side and top arch parts of the TBM in each excavation progress cycle of the TBM.

What is claimed is:

1. A surrounding rock pretreatment method for a TBM passing through a round tunnel section with high rock-burst risk, comprising the following steps:

1.1. determining a pretreatment area, wherein an area in which a clear spacing between a to-be-constructed tunnel and an adjacent existing tunnel in a TBM tunneling direction is less than 2 times that of a tunnel diameter of the TBM to-be-constructed tunnel is the pretreatment area;

1.2. performing controlled blasting;

1.2.1. arranging a plurality of rows of blast holes I in the pretreatment area and a rock pillar area between the existing tunnel and the to-be-constructed tunnel through the existing tunnel;

1.2.2. arranging a plurality of rows of blast holes II on an arch crown of the to-be-constructed tunnel and a spandrel part, far away from the existing tunnel side, of the to-be-constructed tunnel through the existing tunnel;

1.2.3, sequentially detonating the blast holes I and the blast holes II;

1.3. injecting high pressure water, and selecting part of blast holes I to perform cyclic water injection pressurizing; and 1.4. performing normal tunneling by the TBM.

2. The surrounding rock pretreatment method for the TBM passing through the round tunnel section with high rock-burst risk according to claim 1, wherein a blasting charge length L1 of the blast holes I is equal to ⅓ L, L represents a thickness of rock pillars between the existing tunnel and the to-be-constructed tunnel; and a blasting charge length L2 of the blast holes II is equal to is equal to 1.5 D, and D represents a tunnel diameter of the to-be-constructed tunnel.

3. The surrounding rock pretreatment method for the TBM passing through the round tunnel section with high rock-burst risk according to claim 1, wherein a spacing between every two blast holes I along an axis direction of the existing tunnel is 2 m, and a spacing between every two blast holes II along the axis direction of the existing tunnel is 2 m.

4. The surrounding rock pretreatment method for the TBM passing through the round tunnel section with high rock-burst risk according to claim 1, wherein a blasting interval of the blast holes I and the blast holes II is 0.5 s.

5. The surrounding rock pretreatment method for the TBM passing through the round tunnel section with high rock-burst risk according to claim 1, wherein 3 pressure cycles are accumulatively performed during cyclic water injection pressurizing, time of each pressure cycle is more than or equal to 5 minutes, and the maximum pressure is more than or equal to 8 MPa.

6. The surrounding rock pretreatment method for the TBM passing through the round funnel section with high rock-burst risk according to claim 5, wherein water injection is stopped if water flows out of the blast holes I in which water is not injected in water injection engineering.

* * * * *